US008430708B1

(12) United States Patent
Schramm

(10) Patent No.: US 8,430,708 B1
(45) Date of Patent: Apr. 30, 2013

(54) LARGE SPILL-PROOF BUBBLE CREATION APPARATUS

(76) Inventor: Michael R. Schramm, Perry, UT (US)

( * ) Notice: Subject to any disclaimer, the term of this patent is extended or adjusted under 35 U.S.C. 154(b) by 156 days.

(21) Appl. No.: 12/539,803

(22) Filed: Aug. 12, 2009

Related U.S. Application Data

(60) Provisional application No. 61/088,722, filed on Aug. 13, 2008.

(51) Int. Cl.
*A63H 33/28* (2006.01)
*A63H 33/00* (2006.01)

(52) U.S. Cl.
USPC ..... 446/15; 446/16

(58) Field of Classification Search ..... 446/15–21; 220/86.1; 141/98, 326
See application file for complete search history.

(56) References Cited

U.S. PATENT DOCUMENTS

| | | | | | |
|---|---|---|---|---|---|
| 2,810,491 | A | * | 10/1957 | Goldschmidt | 220/501 |
| 2,858,639 | A | | 11/1958 | Lawrence | |
| 3,579,898 | A | | 5/1971 | Hein | 46/7 |
| RE27,449 | E | * | 8/1972 | Bartz | 141/98 |
| 4,180,938 | A | | 1/1980 | La Fata | 46/6 |
| 4,301,841 | A | * | 11/1981 | Sandow | 141/98 |
| 4,840,597 | A | | 6/1989 | Perez | 446/16 |
| 4,957,464 | A | | 9/1990 | Perez | 446/16 |
| 5,088,950 | A | | 2/1992 | LaFata | 446/19 |
| 5,246,046 | A | | 9/1993 | Schramm | 141/98 |
| 5,304,085 | A | | 4/1994 | Novak | 446/15 |
| 5,495,876 | A | | 3/1996 | Schramm | 141/98 |
| 5,832,969 | A | | 11/1998 | Schramm | 141/98 |
| RE36,131 | E | | 3/1999 | Schramm | 141/98 |
| 5,908,057 | A | | 6/1999 | Schramm | 141/98 |
| 6,015,327 | A | | 1/2000 | Kovacs | 446/15 |
| 6,135,842 | A | | 10/2000 | LaFata | 446/15 |
| 6,186,853 | B1 | | 2/2001 | Messina | 446/15 |
| 6,386,138 | B1 | | 5/2002 | Schramm | 118/26 |
| 6,520,822 | B2 | | 2/2003 | Kennedy | 446/15 |
| 6,595,822 | B1 | | 7/2003 | Thai | 446/16 |
| 6,629,870 | B2 | | 10/2003 | Robinson | 446/16 |
| 6,638,131 | B1 | | 10/2003 | Thai | 446/15 |
| 6,857,928 | B2 | | 2/2005 | Thai | 446/15 |
| 6,908,358 | B2 | * | 6/2005 | Lin | 446/16 |
| RE39,443 | E | | 12/2006 | Schramm | 141/98 |
| 7,244,161 | B2 | | 7/2007 | Thai | 446/15 |
| 7,316,357 | B2 | * | 1/2008 | Lindahl et al. | 235/487 |
| 7,524,230 | B2 | | 4/2009 | Thai | 446/15 |
| 2001/0035413 | A1 | | 11/2001 | Thai | 220/213 |

(Continued)

FOREIGN PATENT DOCUMENTS

EP 0094532 11/1983

OTHER PUBLICATIONS

Little Kids, Inc., No-Spill Bubble Tumbler, Date = Circa 1993, p. 1.

(Continued)

*Primary Examiner* — Kien Nguyen
(74) *Attorney, Agent, or Firm* — Michael R. Schramm

(57) ABSTRACT

The present invention is a large sized spill-proof bubble creation apparatus. The apparatus provides for the creation of significantly large sized bubbles without the otherwise attendant spillage of bubble solution and without the requirement of commensurately and impractically large quantities of bubble solution. By incorporating a separable bubble solution bottle as a portion of the container of the apparatus, storage of unused bubble solution is able to be performed quickly and easily.

25 Claims, 12 Drawing Sheets

U.S. PATENT DOCUMENTS

| | | | | |
|---|---|---|---|---|
| 2002/0129763 | A1 | 9/2002 | Schramm | 118/13 |
| 2002/0187716 | A1 | 12/2002 | Kennedy | 446/15 |
| 2003/0155364 | A1 | 8/2003 | Thai | 220/714 |
| 2004/0084453 | A1 | 5/2004 | Thai | 220/259.1 |
| 2005/0130552 | A1 | 6/2005 | Thai | 446/74 |
| 2008/0289975 | A1 | 11/2008 | Sharber | 206/207 |

OTHER PUBLICATIONS

Little Kids, Inc., No-Spill Bubble Tumbler Minis, Date = Circa 1998, p. 1.
Little Kids, Inc., No-Spill Bubble Tumbler Micro Minis, Date = Circa 2004, p. 1.
Little Kids, Inc., No-Spill Big Bubble Bucket, Date = circa 1996, p. 1.
Little Kids, Inc., No-Spill Mini Bubble Bucket, Date = circa 2002, p. 1.
Little Kids, Inc., No-Bubble Mug, Date = circa 1996, p. 1.
Little Kids, Inc., No-Spill Bubble Holster, Date = circa 2007, p. 1.
Little Kids, Inc., No-Spill Motorized Dip 'N Blow Bubbles, Date = 2009, p. 1.
Strombecker, Inc., Mr. Bubbles Spill Proof Bubble Toy, Date = 1995, p. 1.
Strombecker, Inc., Spill Proof Bubble Rocket, Date = 1995, p. 1.
Strombecker, Inc., Spill Proof Elmo's Bubble Fun, Date = circa 1997, p. 1.
Strombecker, Inc., Spill Proof Marvin the Martian Bubble Spaceship, Date = circa 1999, p. 1.
Strombecker, Inc., Spill Proof Hunny Pot, Date = circa 1999, p. 1.
Strombecker, Inc., Spill Proof Tweety Bubble Necklace, Date = circa 1997, p. 1.
Strombecker, Inc., Large Spill Proof Container with Aux Handle, Date = circa 2000, p. 1.
Strombecker, Inc., Medium Spill Proof Container with Aux Handle, Date = circa 2000, p. 1.
Strombecker, Inc., Small Spill Proof Container with Aux Handle, Date = circa 2000, p. 1.
Strombecker, Inc., Mini Spill Proof, Date = circa 2002, p. 1.
Imperial Toy, Inc., No Spill Miracle Bubbles, Date = circa 1996, p. 1.
Imperial Toy, Inc., No-Spill Bubble Submarine, Date = circa 1998, p. 1.
Imperial Toy, Inc., No-Spill Bubble Cell Phone, Date = circa 1998, p. 1.
Imperial Toy, Inc., No Tip No Spill Bubble Tumbler, Date = circa 2001, p. 1.
Imperial Toy, Inc., No-Spill Bubbles 'N Sand Bucket, Date = circa 1999, p. 1.
Little Tykes, Inc., No Spill Bubble Buddy, Date = circa 2001, p. 1.
Little Tykes, Inc., No Spill Bubble Bucket, Date = circa 2001, p. 1.
Placo, Inc., Super Non-Spill Double Tumbler, Date = circa 2000, p. 1.
Placo, Inc., Pivot Top Spill Resistant Bubbles, Date = circa 2002, p. 1.
Placo, Inc., Spill Resistant Giant Bucket, Date = circa 2004, p. 1.
Placo, Inc., Spill Resistant Mini Bucket, Date = circa 2004, p. 1.
Tangent/ToySmith, Inc., Never Spill Resistant Bubbles, Date = circa 2002, p. 1.
Battat, Inc., Non Spill Bubble tumbler, Date = circa 1996, p. 1.
Flair/Funrise, Inc., No Spill Tumbler, Date = circa 2002, p. 1.
Funrise, Inc., Non Spill Bubble Bouncer, Date = circa 2002, p. 1.
Funrise, Inc., Bubble Wubble Tumbler, Date = 2009, p. 1.
Koosh/Oddzon, Inc., Weeble Wobble Bubble Bottle, Date = circa 1999, p. 1.
Toys R Us, Inc., No-Spill Bubble Canteen, Date = circa 1996, p. 1.

* cited by examiner

LARGE SPILL-PROOF BUBBLE CREATION APPARATUS

CROSS REFERENCE TO RELATED APPLICATION

This application claims the benefit under 35 U.S.C. §119 (e) of U.S. Provisional Patent Application No. 61/088,722, filed Aug. 13, 2008, which is incorporated herein in its entirety by this reference.

FIELD OF THE INVENTION

The present invention relates to bubble solution containers, and especially large sized solution consumption efficient spill proof bubble solution containers and spill proof bubble solution containers having a separable and sealable container integrated into the spill proof bubble solution container.

BACKGROUND OF THE INVENTION

Ever since the commercialization of the spill proof bubble solution container invention disclosed in the Schramm U.S. Pat. No. 5,246,046 patent, spill proof bubble solution containers have been widely popular, have become a standard in the industry and have provided autonomy and enjoyment for young children in creating bubbles without the mess that otherwise occurs when using conventional bubble creation devices. Examples of such containers are disclosed in the following US patents and applications and one European patent, all of which are expressly incorporated herein by reference: U.S. Pat. Nos. 7,524,230, 7,244,161, 6,857,928, 6,638,131, 6,629,870, 6,595,822, 6,520,822, 6,386,138, 6,186,853, 6,135,842, 6,015,327, 5,908,057, 5,832,969, 5,495,876, 5,304,085, 5,246,046, 5,088,950, 4,957,464, 4,840,597, 4,180,938, 3,579,898, 2,858,639, RE39,443, RE36,131, 20080289975, 20050130552, 20040084453, 20030155364, 20020187716, 20020129763, 20010035413, and EU0094532. Over the years, many different embodiments of the spill proof bubble solution container have been produced by many different manufacturers. However, two notable aspects of such spill proof bubble solution containers have been lacking, namely 1) a concept for a substantially large size spill proof bubble solution container that doesn't require a commensurately large amount of bubble solution in order to produce bubbles from the spill proof bubble solution container apparatus, and 2) a concept for a spill proof bubble solution container that further provides for reduced mess in adding solution to the spill proof container and in removing solution from the spill proof container for storage when a user is temporarily done using the spill proof bubble solution container. With respect to container size and bubble ring size known commercial products have been relatively small. While conventional (non-spill-resistant) large size bubble creation devices, especially those with bubble rings having inner diameters (ID) of over one inch (e.g. 2, 3, 4, 5, 6 or 7 inch IDs) are widely used in making large bubbles, heretofore, conventional wisdom has been that a funnel opening needed to be relatively small in order to significantly prevent spills. This was especially true of contemplated horizontal entering bubble rings. Heretofore, conventional thinking has also been that spill-proof large bubble solution devices would need such an inordinately large solution capacity, that the product would not be viable. A product table has been prepared to provide size, and bubble solution use efficiency data. In the product table, the spill-proof bubble solution capacity or SPSC defines the amount of bubble solution in ounces that can be contained by the container of the product without any of the bubble solution spilling from the container when the product container funnel is open or unrestricted and the container is oriented in any orientation. Also in the product table, "Apd" defines the appendix that corresponds to the given product. Also in the product table, "OR" defines the orientation in which the bubble creation orifice of the product is inserted through the funnel of the product into the container of the product when the product is in an upright position. Specifically, an "OR of "VT" defines a vertical orientation of a bubble creation orifice, and an "OR" of "HZ" defines a horizontal orientation of a bubble creation orifice. More specifically, a typical bubble creation orifice defines a geometric plane by virtue of the edges of the bubble creation orifice or ring lying within a geometric plane. It is this plane that is used in determining the definition of orientation of the bubble creation orifice with inserted through a funnel and into a container. Also in the product table, the required bubble solution quantity or RBSQ defines the minimum amount of bubble solution in ounces that is required in order for the product to function. Or stated differently, the RBSQ is the minimum amount of bubble solution that is required to be held within the container of the product so as to immerse the bubble creation orifice of the product in bubble solution when the bubble creation orifice is inserted through the funnel of the product and into the container of the product. Also in the product table, the bubble ring opening largest diameter or ROLD defines the value in inches of the largest diameter that will fit within the opening of the fixed shape bubble creation orifice of the product. For instance, if the bubble creation orifice is a circular bubble creation ring, the dimension corresponds to the inner diameter of the bubble ring. Alternatively, if the bubble ring opening is of an irregular shape, the largest diameter that will fit within the opening is a diameter that will be tangent at at least two and usually three locations within the opening. Also in the product table, the sphere or SPHR is the value in cubic inches of a sphere (i.e. a bubble) that has a diameter of the ROLD. Also in the product table, the bubble solution efficiency ratio or BSER defines a value corresponding to a relative efficiency index for the given product. The BSER is defined as the SPHR divided by the RBSQ. Also in the product table, where the appendix number includes the superscript "m", values for the respective product were obtained by actual measurement or calculation, and where the appendix number includes the superscript "e", values for the respective product were obtained by estimation.

PRODUCT TABLE

| Product | Company | Apd | OR | SPSC (oz) | RBSQ (oz) | ROLD (inch) | SPHR ($in^3$) | BSER |
|---|---|---|---|---|---|---|---|---|
| No-Spill Bubble Tumbler | Little Kids | $1^m$ | VT | 6.763 | 2.000 | 0.63 | 0.131 | 0.065 |
| No-Spill Bubble Tumbler Mini | Little Kids | $2^m$ | VT | 0.981 | 0.507 | 0.32 | 0.017 | 0.034 |

-continued

PRODUCT TABLE

| Product | Company | Apd | OR | SPSC (oz) | RBSQ (oz) | ROLD (inch) | SPHR ($in^3$) | BSER |
|---|---|---|---|---|---|---|---|---|
| No-Spill Bubble Tumbler Micro Mini | Little Kids | 3[m] | VT | 0.254 | 0.101 | 0.21 | .005 | 0.048 |
| No-Spill Big Bubble Bucket | Little Kids | 4[m] | VT | 30.4 | 3.04 | 0.75 | 0.221 | 0.073 |
| No-Spill Mini Bubble Bucket | Little Kids | 5[e] | VT | 2.5 | 1.5 | 0.35 | 0.022 | 0.015 |
| No-Spill Bubble Mug | Little Kids | 6[e] | VT | 6.0 | 2.2 | 0.6 | 0.113 | 0.057 |
| Cowboy Bubble Shooter and No-Spill Bubble Holster | Little Kids | 7[e] | HZ | 3.0 | 1.0 | 0.4 | 0.033 | 0.033 |
| No-Spill Motorized Dip 'N Blow Bubbles | Little Kids | 8[m] | HZ | 0.50 | 0.425 | 0.78 | 0.248 | 0.584 |
| Spill Proof Mr. Bubbles | Strombecker | 9[m] | VT | 5.410 | 4.734 | 0.50 | 0.065 | 0.014 |
| Spill Proof Bubble Rocket | Strombecker | 10[e] | VT | 2.3 | 2.0 | 0.5 | 0.065 | 0.033 |
| Spill Proof Elmo's Bubble Fun | Strombecker | 11[m] | VT | 2.367 | 2.367 | 0.70 | 0.180 | 0.076 |
| Spill Proof Marvin The Martian Bubble Spaceship | Strombecker | 12[m] | VT | 6.763 | 5.072 | 0.50 | 0.065 | 0.013 |
| Spill Proof Hunny Pot | Strombecker | 13[m] | VT | 0.845 | 0.507 | 0.40 | 0.033 | 0.066 |
| Spill Proof Tweety Bubble Necklace | Strombecker | 14[m] | VT | 0.75 | 0.5 | 0.35 | 0.022 | 0.045 |
| Large Spill Proof Container with Auxiliary Handle | Strombecker | 15[e] | VT | 10.0 | 7.0 | 0.8 | 0.268 | 0.038 |
| Medium Spill Proof Container with Aux Handle | Strombecker | 16[e] | VT | 8.0 | 5.0 | 0.6 | 0.113 | 0.023 |
| Small Spill Proof Container with Aux Handle | Strombecker | 17[e] | VT | 3.0 | 1.0 | 0.4 | 0.033 | 0.033 |
| Mini Spill Proof | Strombecker | 18[m] | VT | 0.845 | 0.406 | 0.45 | 0.048 | 0.118 |
| No Spill Miracle Bubbles | Imperial Toy | 19[m] | VT | 2.216 | 1.385 | 0.60 | 0.113 | 0.082 |
| No Spill Bubble Submarine | Imperial Toy | 20[m] | VT | 3.314 | 2.435 | 0.60 | 0.113 | 0.046 |
| No Spill Bubble Cell Phone | Imperial Toy | 21[m] | VT | 0.665 | 0.294 | 0.38 | 0.029 | 0.098 |
| No Tip No Spill Tumbler | Imperial Toy | 22[m] | VT | 2.536 | 1.860 | 0.55 | 0.087 | 0.047 |
| No Spill Bubbles 'N Sand Bucket | Imperial Toy | 23[e] | VT | 18.94 | 15.22 | 0.65 | 0.144 | 0.009 |
| No Spill Bubble Buddy | Little Tykes | 24[e] | VT | 2.5 | 1.85 | 0.5 | 0.065 | 0.035 |
| No Spill Bubble Bucket | Little Tykes | 25[m] | VT | 18.94 | 15.22 | 0.65 | 0.144 | 0.009 |
| Super Non-Spill Double Tumbler | Placo | 26[e] | VT | 6.7 | 2.0 | 0.6 | 0.113 | 0.057 |
| Pivot Top Spill Resistant Bubbles | Placo | 27[m] | VT | 1.183 | 0.575 | 0.30 | 0.014 | 0.025 |
| Spill Resistant Giant Bucket | Placo | 28[e] | VT | 18.94 | 15.22 | 0.65 | 0.144 | 0.009 |
| Spill Resistant (Mini) Bucket | Placo | 29[m] | VT | 2.536 | 1.522 | 0.35 | 0.022 | 0.015 |
| Never Spill Bubbles | Tanget Toy (ToySmith) | 30[e] | VT | 2.2 | 1.3 | 0.5 | 0.065 | 0.050 |
| Non Spill Bubble Tumbler | Battat | 31[e] | VT | 2.2 | 1.3 | 0.5 | 0.065 | 0.050 |
| No Spill Tumbler | Flair/Funrise | 32[e] | VT | 1.1 | 0.6 | 0.3 | 0.014 | 0.024 |
| (Non Spill) Bubble Bouncer | Funrise | 33[e] | VT | 1.1 | 0.6 | 0.3 | 0.014 | 0.024 |
| Bubble Wubble Tumbler | Funrise | 34[m] | VT | 0.792 | 0.713 | 0.4 | 0.033 | 0.047 |
| Weeble Wobble Bubble Bottle | Koosh/OddzOn | 35[m] | VT | 6.864 | 2.096 | 0.60 | 0.113 | 0.054 |
| No-Spill Canteen (Bubble Explorer) | Toys R Us | 36[e] | VT | 7.0 | 6.0 | 1.0 | 0.523 | 0.087 |
| No-Spill Bubble Tumbler - Scaled to have a 6.3 ROLD. | NA | NA[m] | VT | 6763 | 2000 | 6.30 | 130.89 | 0.065 |
| Spill Proof Bubble Creation Apparatus | Embodiment 1 | NA[m] | HZ | 4.00 | 1.50 | 3.5 | 22.438 | 14.959 |
| Spill Proof Bubble Creation Apparatus | Embodiment 2 | NA[m] | VT | 14.67 | 9.24 | 6.30 | 130.9 | 14.17 |

SUMMARY OF THE INVENTION

The present invention therefore is a spill-proof bubble solution apparatus that is preferably highly bubble solution efficient. The apparatus is preferably large and preferably includes a bubble creation device having a substantially large bubble creation ring (e.g. a bubble ring having an ID in inches of 1, 2, 3, 4, 5, 6, 7, or greater, or any value in-between thereof). The apparatus further preferably includes a container defining a removable assembly of a first portion and a second portion. The second portion preferably defines a bubble solution storage container and more preferably a standard bubble solution bottle. The container assembly is adapted such that when the assembly is oriented in an upright orientation, substantially all bubble solution contained within the assembled container flows into the second portion. The container assembly is further adapted such that the second portion may be readily removed from the first portion and sealed so as to temporarily store unused bubble solution.

DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
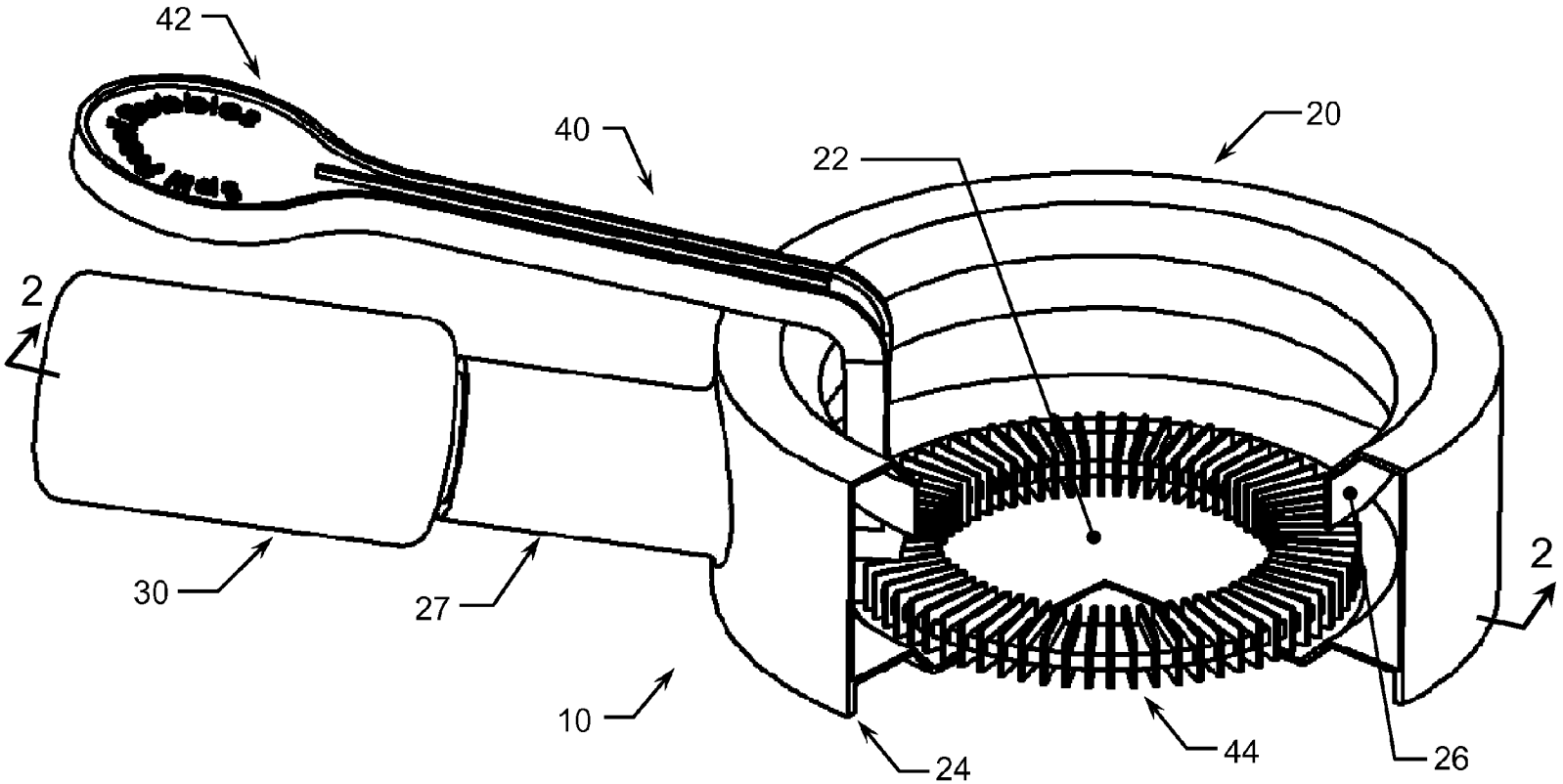
FIG. 1 is an isometric view of a first embodiment of the large spill-proof bubble creation apparatus shown with a near side section of the bubble pan of the apparatus shown cut-away.
Figure 2:
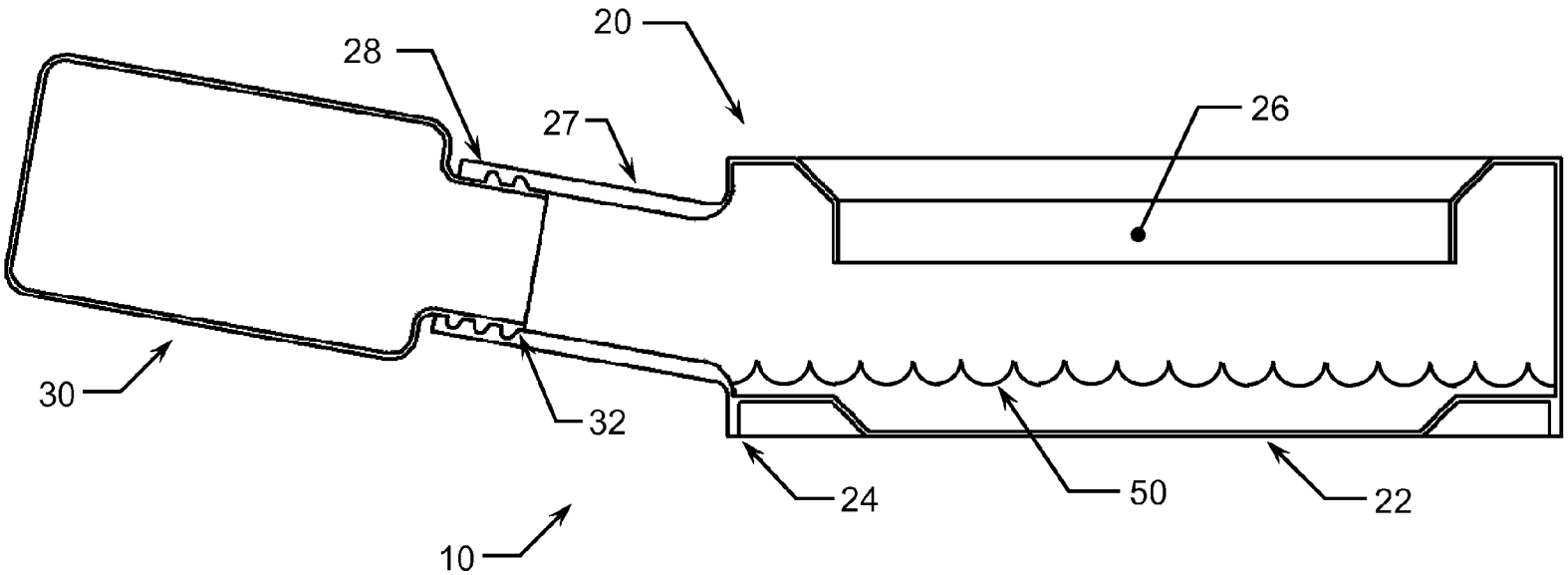
FIG. 2 is an orthographic side section view a first embodiment of the large spill-proof bubble creation apparatus taken substantially at the location of the section arrows 2 shown in FIG. 1, and is shown in an upright (or normal usage) orientation with bubble solution shown positioned in the trough of the bubble pan.
Figure 3:
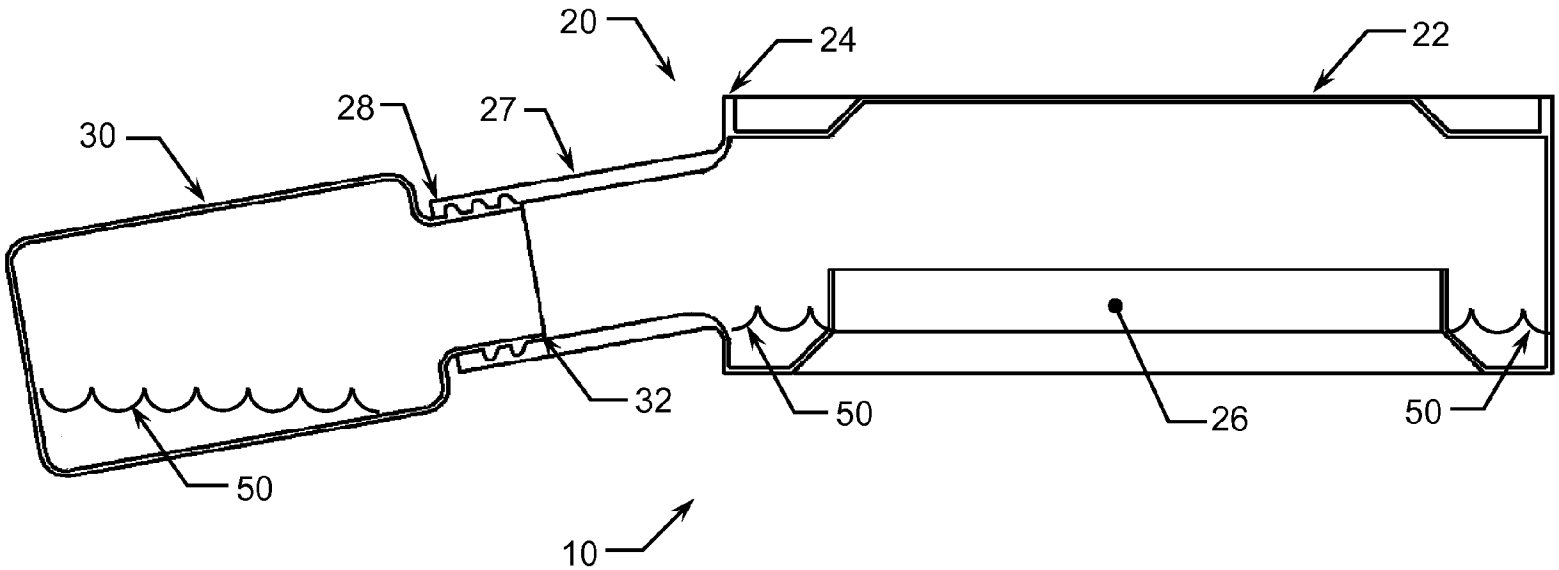
FIG. 3 is substantially identical to FIG. 2 except that in FIG. 3 the large spill-proof bubble creation apparatus is shown in an upside-down orientation with bubble solution shown positioned around the funnel of the bubble pan and in the bubble bottle.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In order to facilitate the understanding of the present invention in reviewing the drawings accompanying the specification, a feature table is provided below. It is noted that like features are like numbered throughout all of the figures.

FEATURE TABLE

| # | Feature |
|---|---|
| 10 | Spill-proof bubble creation apparatus |
| 20 | Spill-proof bubble pan |
| 22 | Trough |
| 24 | Stand |
| 26 | Funnel |
| 27 | Spout |
| 28 | Threaded mouth |
| 30 | Bubble bottle |
| 32 | Threaded mouth |
| 40 | Bubble wand |
| 42 | Handle |
| 44 | Bubble ring |
| 50 | Bubble solution |
| 60 | Spill-proof bubble creation apparatus |
| 70 | Bubble solution container |
| 72 | Trough |
| 74 | Fill indication marking |
| 80 | Lid |
| 82 | funnel |
| 84 | Spout |
| 90 | Cap |
| 100 | Bubble wand |
| 102 | Handle |
| 104 | Bubble ring |

Referring now to the drawings, and in particular to FIGS. 1 through 5, the first embodiment of the invention is a spill-proof bubble creation apparatus 10 for use in creating large bubbles without the otherwise attendant spillage of bubble solution comprising a spill-proof bubble pan 20, a bubble bottle 30, and a bubble wand 40. Spill-proof bubble pan 20 defines a generally cylindrical shaped container having a trough 22, a stand 24, an inwardly impending funnel 26, a spout 27, and a preferably threaded spout mouth 28. Funnel 26 is preferably sufficiently large so as to allow a sphere of at least 4.0 inches in diameter to pass through the funnel. Bubble bottle 30 defines a standard generally cylindrical shaped bottle having a preferably threaded mouth 32. Bubble bottle 30 preferable defines one of a standard volume size of bubble bottle, for instance a four ounce bottle, an eight ounce bottle, a twelve ounce bottle or a sixteen ounce bottle. Bubble wand 40 defines a substantially large sized bubble wand having a handle 42 and a bubble ring 44. Bubble ring 44 of the bubble wand 40 preferably has an inner diameter opening of about 3.5 inches. Bubble wand 40 is adapted to dip the bubble ring into bubble solution in a horizontal position or attitude.

Figure 4:
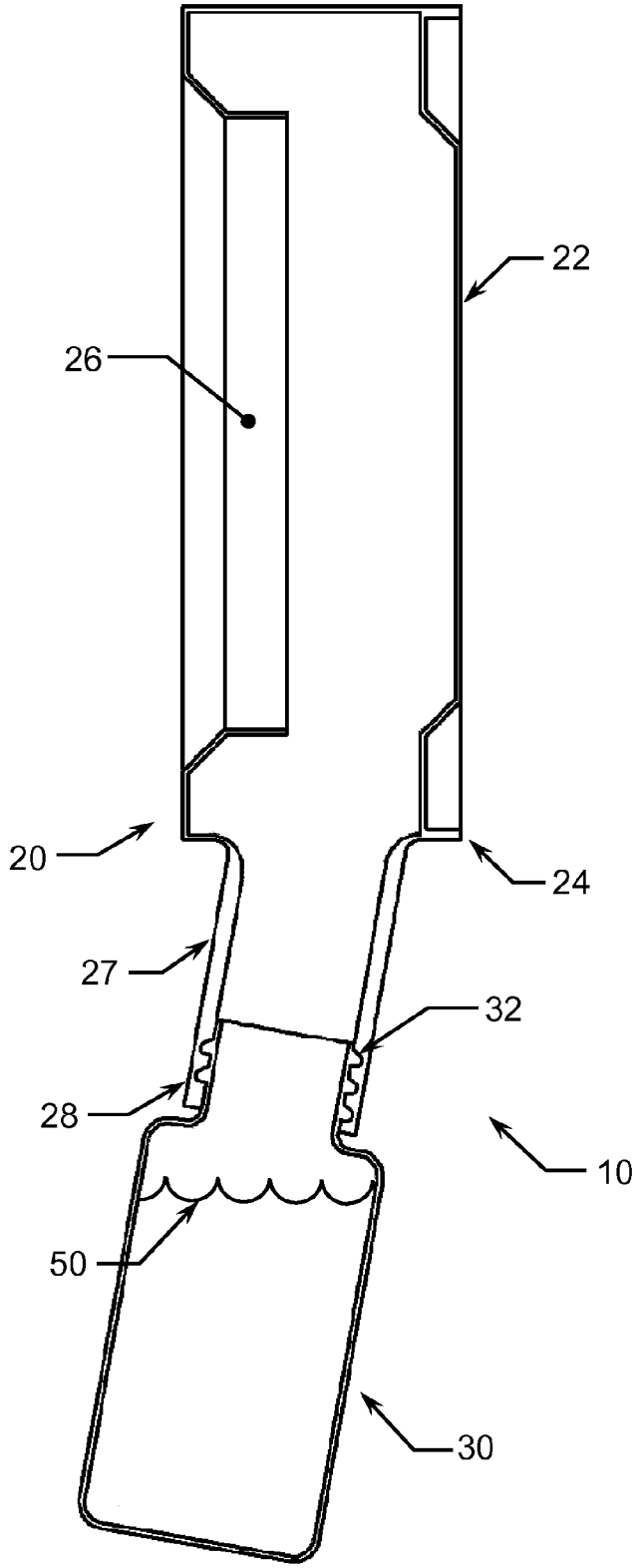
FIG. 4 is substantially identical to FIG. 2 except that in FIG. 4 the large spill-proof bubble creation apparatus shown in a "tipped up" orientation such that the bubble pan is positioned above the bottle and with bubble solution shown positioned in the bottle.
Figure 5:
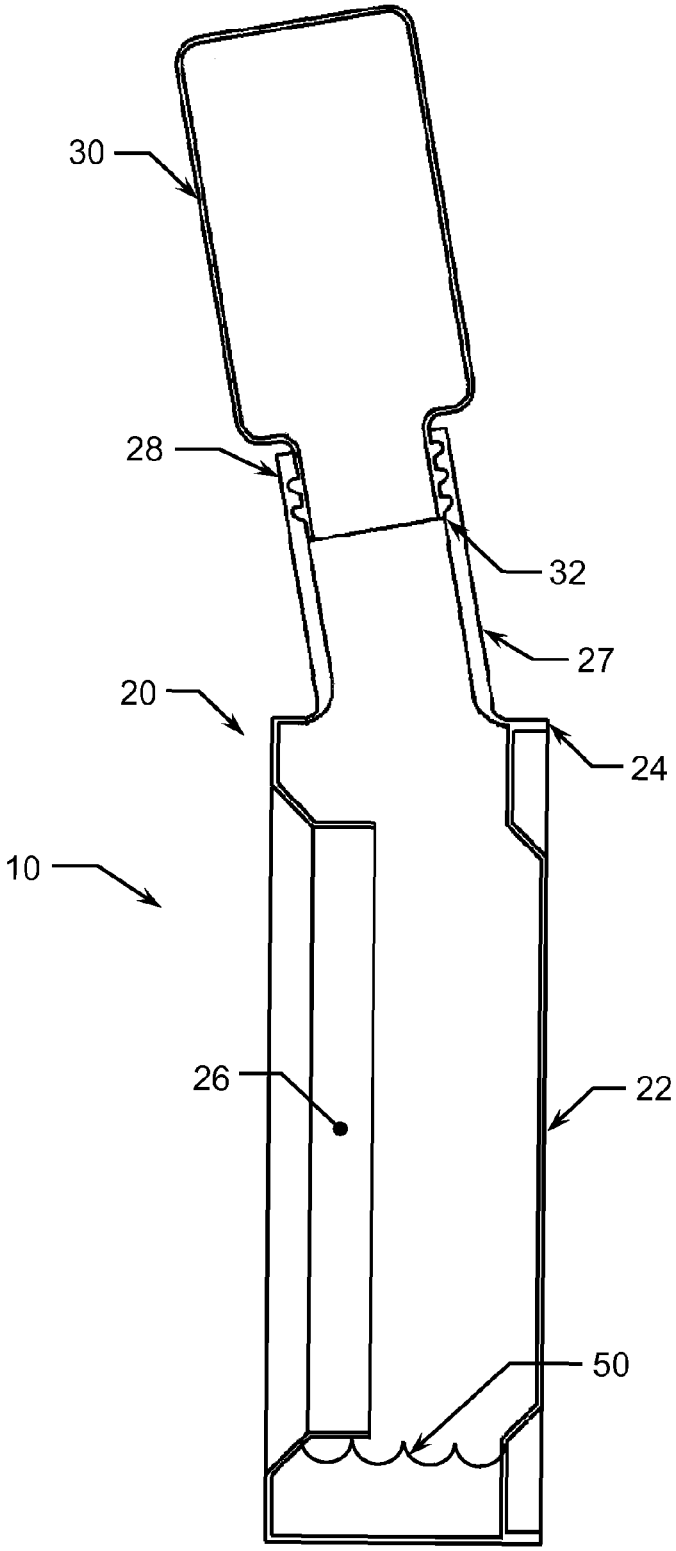
FIG. 5 is substantially identical to FIG. 2 except that in FIG. 5 the large spill-proof bubble creation apparatus shown in a "tipped down" orientation such that the bubble pan is positioned below the bottle and with bubble solution shown positioned in the lower side of the bubble pan.
Figure 6:
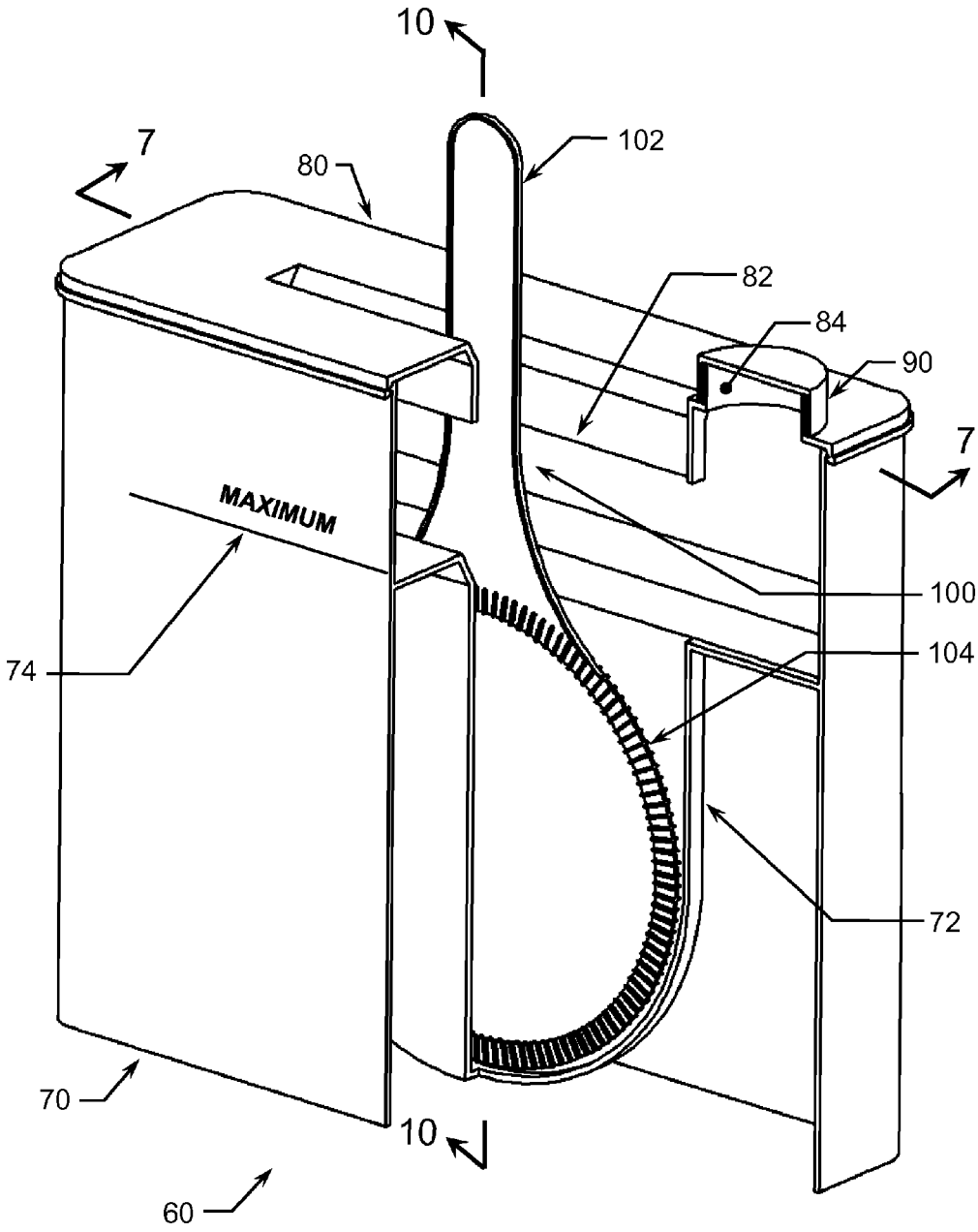
FIG. 6 is an isometric view of a second embodiment of the large spill-proof bubble creation apparatus shown with a near side section of the bubble solution container of the apparatus shown cut-away.
Figure 7:
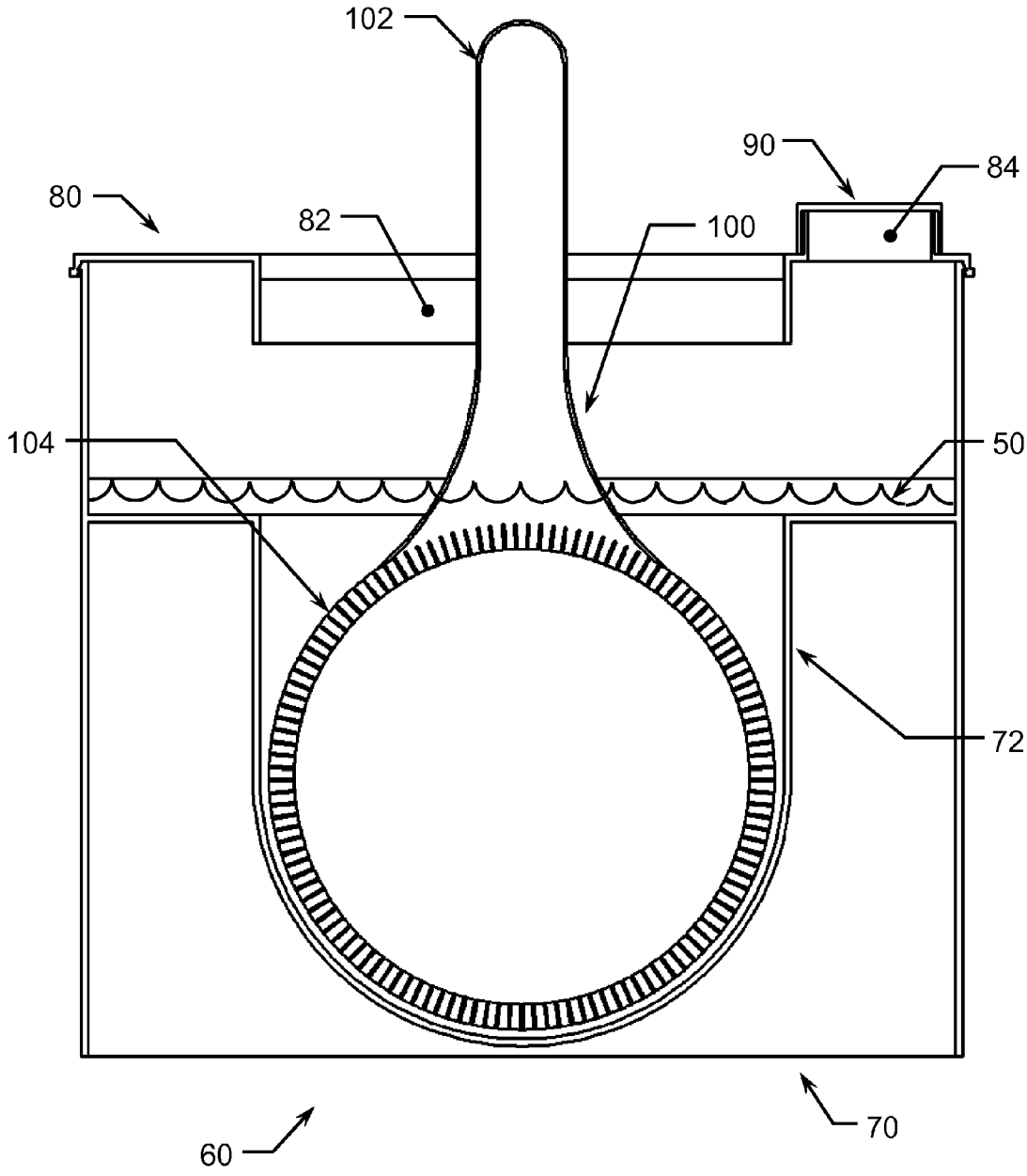
FIG. 7 is an orthographic front section view a second embodiment of the large spill-proof bubble creation apparatus taken substantially at the location of the section arrows 7 shown in FIG. 6, and is shown in an upright (or normal usage) orientation with bubble solution shown positioned in the trough of the bubble container.
Figure 8:
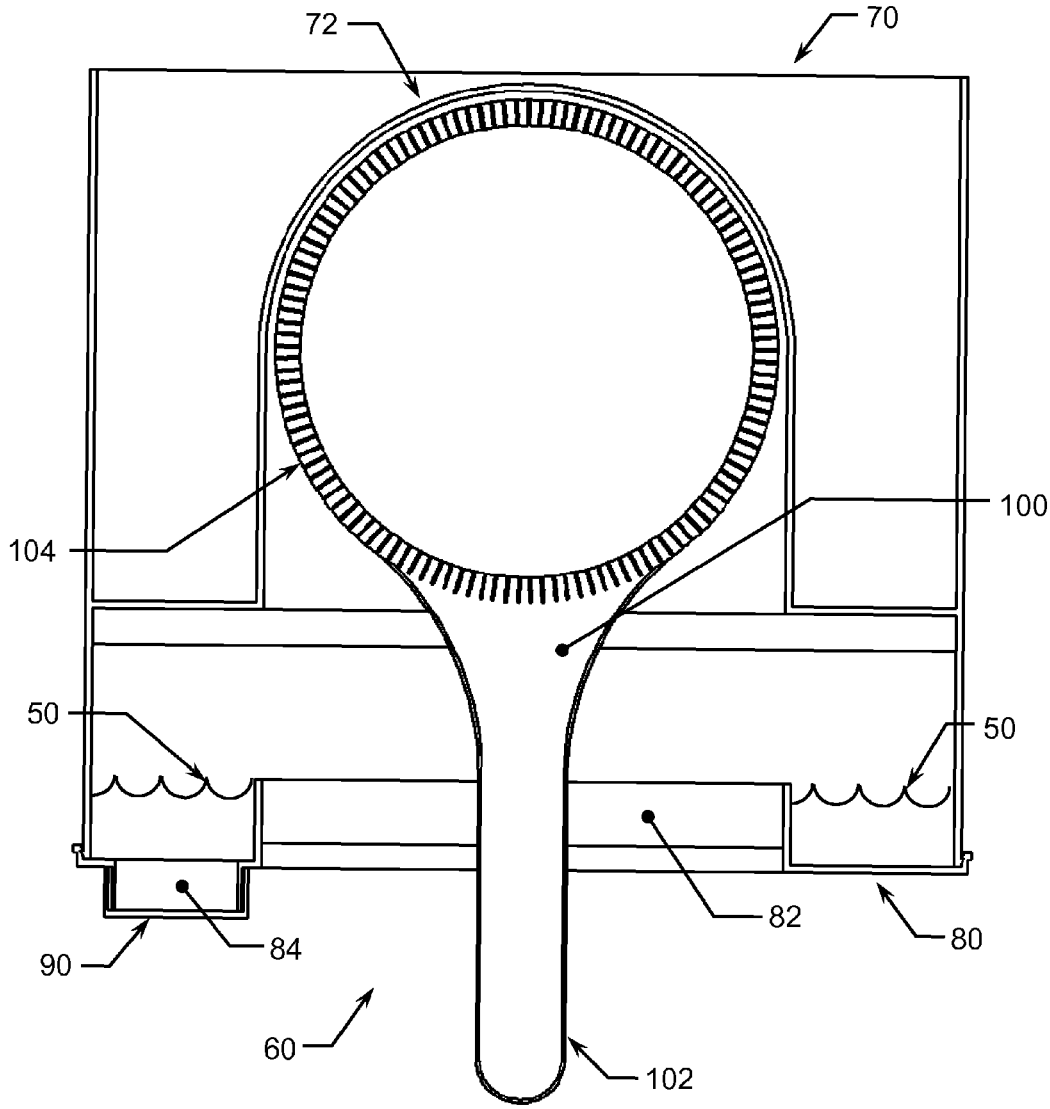
FIG. 8 is substantially identical to FIG. 7 except that in FIG. 8 the large spill-proof bubble creation apparatus is shown in an upside-down orientation with bubble solution shown positioned around the funnel of the bubble container.
Figure 9:
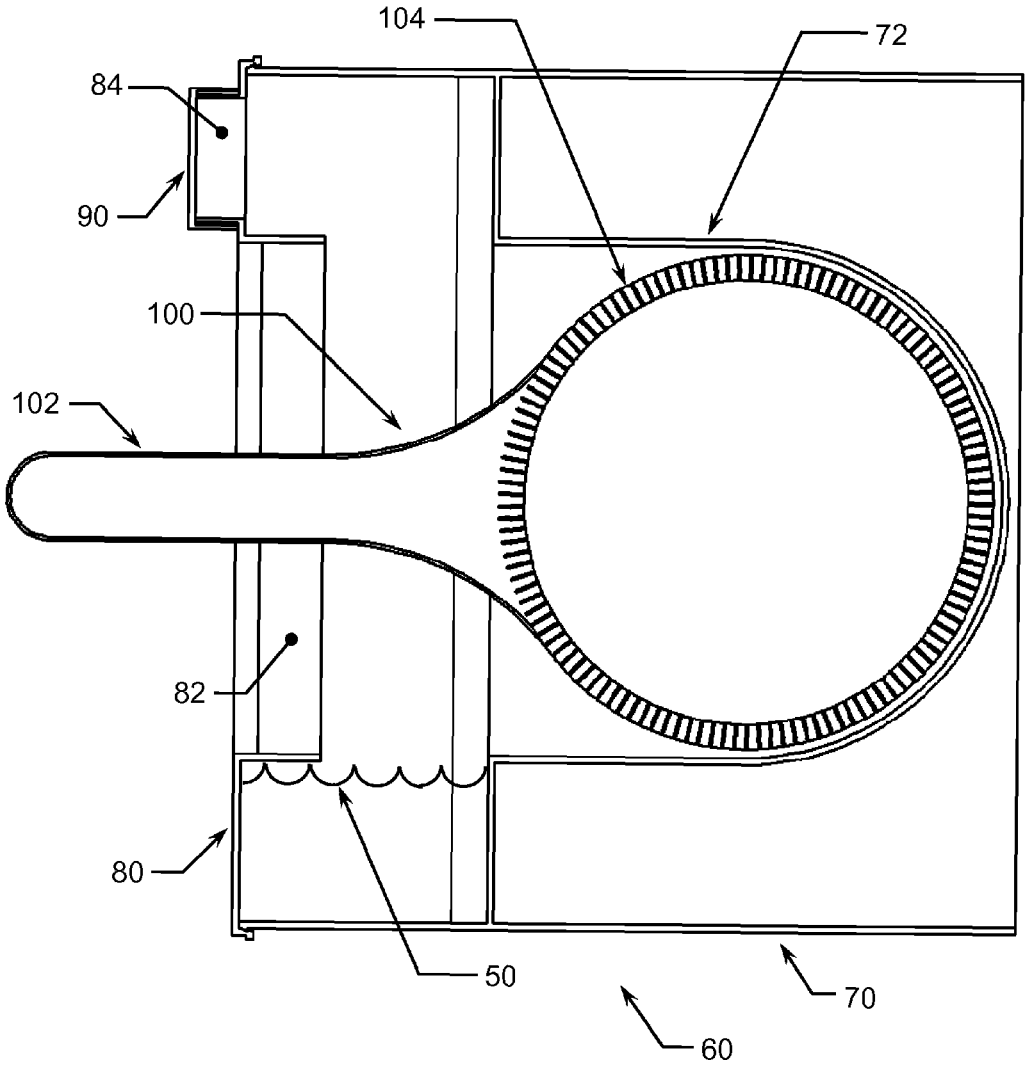
FIG. 9 is substantially identical to FIG. 7 except that in FIG. 9 the large spill-proof bubble creation apparatus is shown in a side-ways orientation with bubble solution shown positioned in a side of the container below the funnel of the apparatus.
Figure 10:
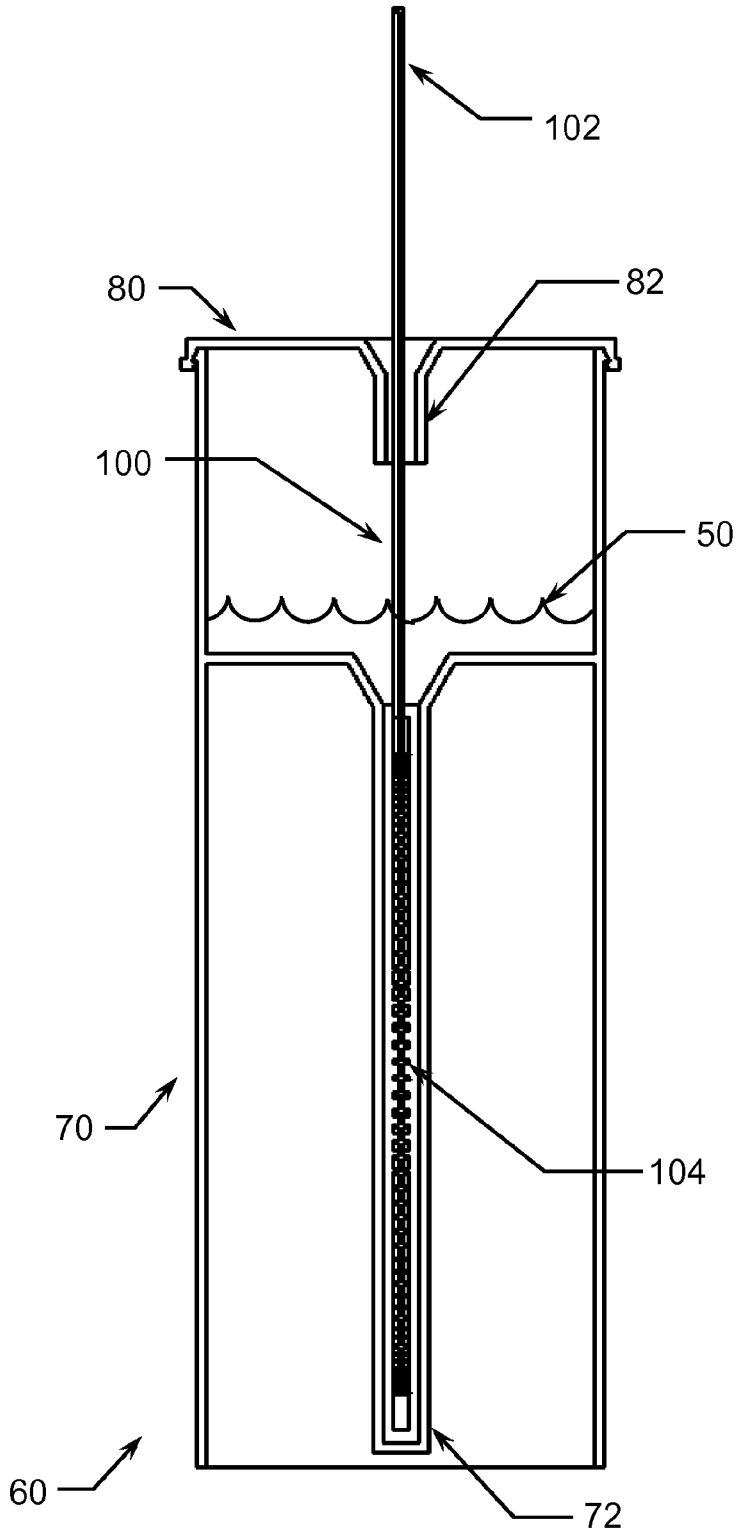
FIG. 10 is an orthographic side section view a second embodiment of the large spill-proof bubble creation apparatus taken substantially at the location of the section arrows 10 shown in FIG. 6, and is shown in an upright (or normal usage) orientation with bubble solution shown positioned in the trough of the bubble container.
Figure 11:
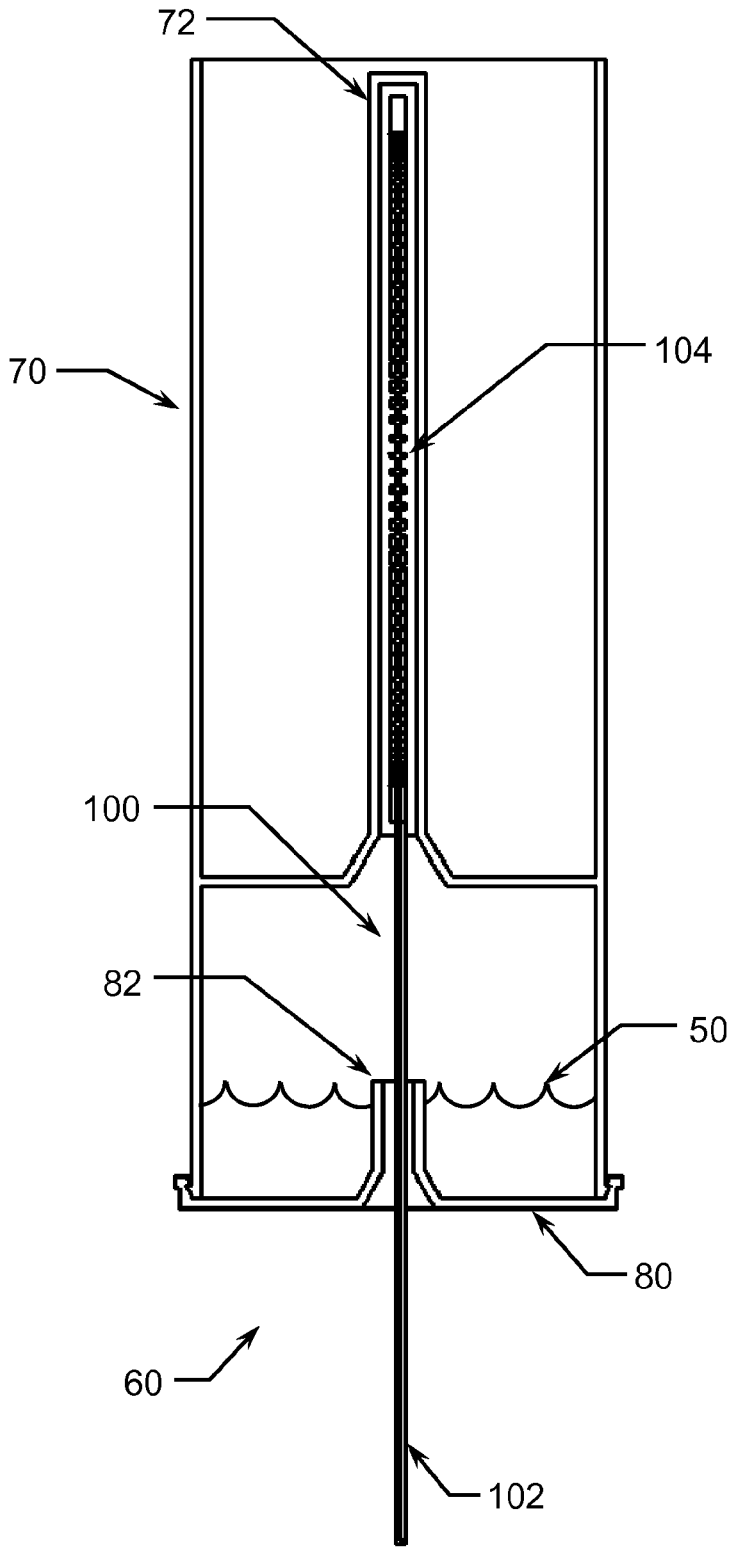
FIG. 11 is substantially identical to FIG. 10 except that in FIG. 11 the large spill-proof bubble creation apparatus is shown in an upside-down orientation with bubble solution shown positioned around the funnel of the bubble container.
Figure 12:
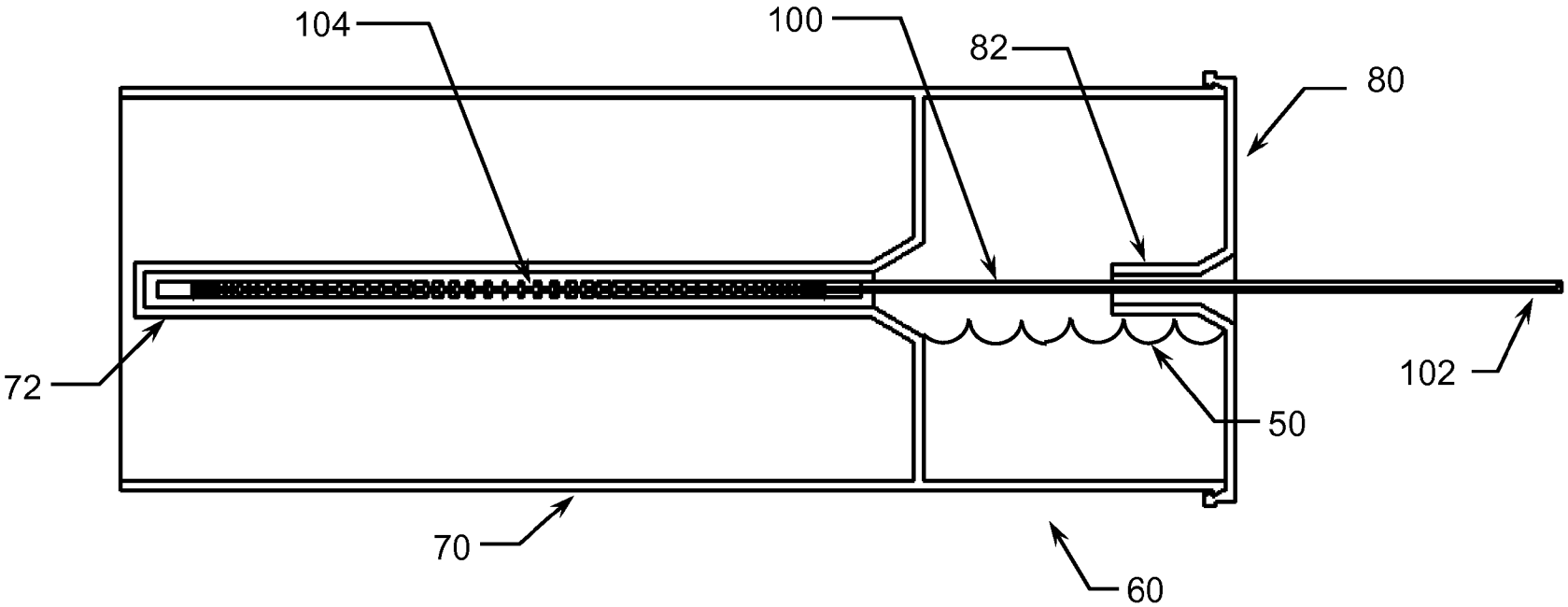
FIG. 12 is substantially identical to FIG. 10 except that in FIG. 12 the large spill-proof bubble creation apparatus is shown in a side-ways orientation with bubble solution shown positioned in a side of the container below the funnel of the apparatus.

In practice, with bubble bottle 30 and bubble pan 20 oriented in the position shown in FIG. 4, bubble bottle 30 containing bubble solution 50 is threaded onto spout 27 of bubble pan 20. Once thus assembled, spill-proof bubble creation apparatus 10 may be oriented in any orientation including the orientations shown in FIGS. 3 and 5 without bubble solution running out of or spilling from spill-proof bubble creation apparatus 10. In order to create a bubble, a user merely dips bubble ring 44 of bubble wand 40 through funnel 26 of bubble pan 20 and into trough 22 of bubble pan 20 and subsequently removes refreshed bubble wand 40 and blows a bubble. Because the opening of funnel 26 is large and easily accessible (in spite of being spill-proof), the creation of bubbles using apparatus 10 remains a simple task for a child. When the user is temporarily done using apparatus 10, the user merely returns apparatus 10 to the orientation shown in FIG. 4, disassembles bubble bottle 30 from bubble pan 20, and places a cap on bubble bottle 30. It is noted that if the user is a child, an adult may perform the functions of filling and draining apparatus 10. Bubble pan 20 may then be readily rinsed out with clean water. This method of use of apparatus 10 provides for a convenient way of storing unused bubble solution 50 for the large sized apparatus 10. It is noted that apparatus 10 requires very little bubble solution 50 to create a bubble give the size of bubble ring 44. In spite of the capacity to produce relatively large sized bubbles, spill-proof bubble creation apparatus 10 has a BSER of nearly 15.0. The BSER and other data of the first embodiment of the invention are shown in the product table.

Referring now to the drawings, and in particular to FIGS. 6 through 12, the second embodiment of the invention is a spill-proof bubble creation apparatus 60 for use in creating large bubbles without the otherwise attendant spillage of bubble solution comprising a bubble solution container 70, a container lid 80, a cap 90 and a bubble wand 100. Bubble solution container 70 defines a generally rectangular shaped open container having a trough 72 and a fill indication marking 74. Container lid 80 defines a generally rectangular shaped lid having a generally rectangular shaped funnel 82 and an open preferably threaded spout 84. Funnel 82 is preferably sufficiently large so as to allow a bubble wand having an open inner diameter of 6.3 inches to pass through funnel 82. Specifically, funnel 82 preferably has a substantially rectangular open cross-section area having a width of 0.30 inches and a length of 7.25 inches. Cap 90 defines a standard preferably threaded cap. Bubble wand 100 defines a substantially large sized bubble wand having a handle 102 and a bubble ring 104. Bubble ring 104 of bubble wand 102 preferably has an inner diameter opening of about 6.3 inches. Bubble wand 100 is adapted to dip bubble ring 104 into bubble solution 50 in a vertical position or attitude.

In practice, container lid 80 is snappingly and sealingly engaged to bubble solution container 70 such that funnel 82 of lid 80 extends inwardly into bubble solution container 70. Cap 90 is threadingly and sealingly attached to spout 84 of container lid 80. A predetermined amount of bubble solution 50 is poured into assembled apparatus 60 through open funnel 82. Alternatively, cap 90 of apparatus 60 may be removed, bubble solution 50 may be poured into apparatus 60 through spout 84, and cap 90 may be replaced. Once thus assembled, spill-proof bubble creation apparatus 60 may be oriented in any orientation without bubble solution running out of or spilling from spill-proof bubble creation apparatus 60. In order to create a bubble, a user merely dips bubble ring 104 of bubble wand 100 through funnel 82 of container lid 80 and into trough 72 of container 70 and subsequently removes refreshed bubble wand 100 and blows a bubble. Because the opening of funnel 82 is large and easily accessible (in spite of being spill-proof), the creation of bubbles using apparatus 60 remains a simple task for a child. When the user is temporarily done using apparatus 60, the user may merely remove cap 90 from apparatus 60 and pour any unused bubble solution 50 out of apparatus 60 and into a storage container such as a bubble solution bottle. Optionally, a bottle may be used in place of cap 90 so as to provide for storage of unused bubble solution. It is noted that if the user is a child, an adult may perform the functions of filling and draining apparatus 60. Apparatus 60 may be readily disassembled and rinsed out with clean water. This method of use of apparatus 60 provides for a convenient way of storing unused bubble solution for the large sized apparatus 60. It is noted that apparatus 60 requires very little bubble solution to create a bubble give the size of bubble ring 104. In spite of the capacity to produce relatively large sized bubbles, spill-proof bubble creation apparatus 60 has a BSER of over 14.0. The BSER and other data of the second embodiment of the invention are shown in the product table.

To illustrate the extraordinary efficiency of both the first and the second embodiments of the spill-proof bubble creation invention, the following example is provided. The No-Spill Bubble Tumbler produced by Little Kids, Inc., which has a bubble ring inner diameter opening of 0.63 inches, was theoretically scaled up to have a bubble ring inner diameter opening of 6.30 inches. Such 6.30 inch diameter bubble ring inner opening is ten times the size of the actual opening of the bubble ring of the bubble tumbler and is the same size as the bubble ring inner diameter opening of the second embodiment of the spill-proof bubble creation invention (apparatus 60). Using this same ratio of 10 to 1, the container diameter, container depth and all other dimensions were correspondingly scaled up. In the scaled up configuration, the data for which is also provided in the product table, the scaled up device requires an impractically large 2000 ounces of bubble solution in order to function to create bubbles. To put such an amount of bubble solution into perspective, 2000 ounces of bubble solution, an amount 1000 times the requirement of the actual bubble tumbler, equates to more than 15 gallons of bubble solution. In spite of the large quantity required, the scaled up device maintains the same relatively meager BSER of 0.065. Clearly such a large quantity renders such a product impractical and has heretofore prevented the introduction of substantially large sized spill-proof bubble solution containers.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A container for use in accessing bubble creation solution in said container to create large bubbles while preventing spillage of bubble creation solution in said container and while minimizing the quantity of bubble creation solution required to create a bubble, said container having an inner cavity and an open funnel extending into said inner cavity and terminating in a substantially rectangular shaped funnel opening within said inner cavity, said substantially rectangular shaped funnel opening having an opening width of at least 0.10 inches and an opening length of at least 1.50 inches.

2. The container of claim 1, wherein said substantially rectangular shaped funnel opening defines a substantially rectangular shaped funnel opening having a width and length combination of at least one of the following width and length combinations comprising a width of no less than 0.10 inches and a length of no less than 1.75 inches, a width of no less than 0.10 inches and a length of no less than 2.0 inches, a width of no less than 0.10 inches and a length of no less than 2.25 inches, a width of no less than 0.10 inches and a length of no less than 2.5 inches, a width of no less than 0.10 inches and a length of no less than 2.75 inches, a width of no less than 0.10 inches and a length of no less than 3.0 inches, a width of no less than 0.10 inches and a length of no less than 3.25 inches, a width of no less than 0.10 inches and a length of no less than 3.5 inches, a width of no less than 0.10 inches and a length of no less than 4.0 inches, a width of no less than 0.10 inches and a length of no less than 5.0 inches, a width of no less than 0.10 inches and a length of no less than 6.0 inches, a width of no less than 0.10 inches and a length of no less than 7.0 inches and a width of no less than 0.30 inches and a length of no less than 7.25 inches.

3. The container of claim 1, wherein said container is combined with a bubble creation device to form a bubble creation apparatus, and wherein said bubble creation device is removably positioned at least partially within said container, said bubble creation device having a bubble creation opening, and wherein said apparatus has a bubble solution efficiency ratio (BSER), and wherein said BSER defines at least one of the following BSERs comprising a BSER of no less than 0.125, a BSER of no less than 0.150, a BSER of no less than 0.175, a BSER of no less than 0.200, a BSER of no less than 0.225, a BSER of no less than 0.250, a BSER of no less than 0.275, a BSER of no less than 0.300, a BSER of no less than 0.325, a BSER of no less than 0.350, a BSER of no less than 0.375, a BSER of no less than 0.400, a BSER of no less than 0.425, a BSER of no less than 0.450, a BSER of no less than 0.475, a BSER of no less than 0.500, a BSER of no less than 0.600, a BSER of no less than 0.700, a BSER of no less than 0.800, a BSER of no less than 0.900, a BSER of no less than 1.00, a BSER of no less than 1.25, a BSER of no less than 1.50, a BSER of no less than 1.75, a BSER of no less than 2.00, a BSER of no less than 2.50, a BSER of no less than 2.75, a BSER of no less than 3.00, a BSER of no less than 3.50, a BSER of no less than 4.00, a BSER of no less than 5.0, a BSER of no less than 6.0, a BSER of no less than 7.0, a BSER of no less than 8.0, a BSER of no less than 9.0, a BSER of no less than 10, a BSER of no less than 11, a BSER of no less than 12, a BSER of no less than 13 and a BSER of no less than 14.

4. The container of claim 1, wherein said container defines an assembly of a first container portion and a second container portion, and wherein said first container portion defines a container portion having an inner cavity, an open funnel extending into said inner cavity, and a spout, and wherein said second container portion defines a container portion having an inner cavity.

5. The container of claim 1, wherein said container is combined with a bubble creation device to form a bubble creation apparatus, and wherein said bubble creation device is removably positioned at least partially within said container, said bubble creation device having a fixed geometry bubble creation opening, and wherein said bubble creation opening defines a bubble creation opening adapted such that a sphere may pass through said fixed geometry bubble creation opening, said sphere comprising a sphere having at least one of the following diameters comprising a diameter of no less than 1.25 inches, a diameter of no less than 1.50 inches, a diameter of no less than 1.75 inches, a diameter of no less than 2.00 inches, a diameter of no less than 2.25 inches, a diameter of no less than 2.50 inches, a diameter of no less than 2.75 inches, a diameter of no less than 3.00 inches, a diameter of no less than 3.50 inches, a diameter of no less than 4.00 inches, a diameter of no less than 4.50 inches, a diameter of no less than 5.0 inches, a diameter of no less than 6.0 inches and a diameter of no less than 6.25 inches.

6. A spill-resistant bubble creation apparatus for use in accessing bubble creation solution in said apparatus to create large bubbles while preventing spillage of bubble creation solution in said apparatus and while minimizing the quantity of bubble creation solution required to create a bubble, said apparatus comprising a container having an inner cavity and an open funnel extending into said inner cavity and a bubble creation device removably positioned at least partially within said container, wherein said bubble creation device includes a bubble creation opening, and wherein said apparatus has a bubble solution efficiency ratio (BSER) of at least 0.125.

7. The apparatus of claim 6, wherein said funnel defines a substantially rectangular shaped funnel having a substantially rectangular shaped open cross-section having an opening width of at least 0.10 inches and an opening length of at least 1.50 inches.

8. The container of claim 7, wherein said substantially rectangular shaped open cross-section defines a substantially rectangular shaped open cross-section having a width and length combination of at least one of the following width and length combinations comprising a width of no less than 0.10 inches and a length of no less than 1.75 inches, a width of no less than 0.10 inches and a length of no less than 2.0 inches, a width of no less than 0.10 inches and a length of no less than 2.25 inches, a width of no less than 0.10 inches and a length of no less than 2.5 inches, a width of no less than 0.10 inches and a length of no less than 2.75 inches, a width of no less than 0.10 inches and a length of no less than 3.0 inches, a width of no less than 0.10 inches and a length of no less than 3.25 inches, a width of no less than 0.10 inches and a length of no less than 3.5 inches, a width of no less than 0.10 inches and a length of no less than 4.0 inches, a width of no less than 0.10 inches and a length of no less than 5.0 inches, a width of no less than 0.10 inches and a length of no less than 6.0 inches, a width of no less than 0.10 inches and a length of no less than 7.0 inches and a width of no less than 0.30 inches and a length of no less than 7.25 inches.

9. The apparatus of claim 6, wherein said bubble creation opening defines a fixed geometry bubble creation opening, and wherein said bubble creation opening defines a bubble creation opening adapted such that a sphere may pass through said fixed geometry bubble creation opening, said sphere comprising a sphere having at least one of the following diameters comprising a diameter of no less than 1.25 inches, a diameter of no less than 1.50 inches, a diameter of no less than 1.75 inches, a diameter of no less than 2.00 inches, a diameter of no less than 2.25 inches, a diameter of no less than 2.50 inches, a diameter of no less than 2.75 inches, a diameter of no less than 3.00 inches, a diameter of no less than 3.50 inches, a diameter of no less than 4.00 inches, a diameter of no less than 4.50 inches, a diameter of no less than 5.0 inches, a diameter of no less than 6.0 inches and a diameter of no less than 6.25 inches.

10. The apparatus of claim 6, wherein said apparatus further defines an apparatus having at least one of a substantially rectangular shaped funnel opening and a vertically oriented bubble creation opening.

11. The apparatus of claim 10, wherein said BSER defines at least one of the following BSERs comprising a BSER of no less than 0.150, a BSER of no less than 0.175, a BSER of no less than 0.200, a BSER of no less than 0.225, a BSER of no less than 0.250, a BSER of no less than 0.275, a BSER of no less than 0.300, a BSER of no less than 0.325, a BSER of no less than 0.350, a BSER of no less than 0.375, a BSER of no less than 0.400, a BSER of no less than 0.425, a BSER of no less than 0.450, a BSER of no less than 0.475, a BSER of no less than 0.500, a BSER of no less than 0.600, a BSER of no less than 0.700, a BSER of no less than 0.800, a BSER of no less than 0.900, a BSER of no less than 1.00, a BSER of no less than 1.25, a BSER of no less than 1.50, a BSER of no less than 1.75, a BSER of no less than 2.00, a BSER of no less than 2.50, a BSER of no less than 2.75, a BSER of no less than 3.00, a BSER of no less than 3.50, a BSER of no less than 4.00, a BSER of no less than 5.0, a BSER of no less than 6.0, a BSER of no less than 7.0, a BSER of no less than 8.0, a BSER of no less than 9.0, a BSER of no less than 10, a BSER of no less than 11, a BSER of no less than 12, a BSER of no less than 13 and a BSER of no less than 14.

12. A container for use in accessing bubble creation solution in said container to create large bubbles while preventing spillage of bubble creation solution in said container and while minimizing the quantity of bubble creation solution required to create a bubble, and while avoiding the need to pour bubble creation solution into and out of a separate bubble creation solution storage receptacle, said container defining an assembly of at least a first container portion and a second container portion, and wherein said first container portion defines a container portion having an inner cavity, an open funnel extending into said inner cavity, and a spout, and wherein said second container portion defines a container portion having an inner cavity, and wherein said second container portion is removably and sealingly connected to said spout of said first container portion.

13. The container of claim 12, wherein said funnel defines a substantially rectangular shaped funnel having a substantially rectangular shaped open cross-section having an opening width of at least 0.10 inches and an opening length of at least 1.50 inches.

14. The container of claim 13, wherein said substantially rectangular shaped open cross-section defines a substantially rectangular shaped open cross-section having a width and length combination of at least one of the following width and length combinations comprising a width of no less than 0.10 inches and a length of no less than 1.75 inches, a width of no less than 0.10 inches and a length of no less than 2.0 inches, a width of no less than 0.10 inches and a length of no less than 2.25 inches, a width of no less than 0.10 inches and a length of no less than 2.5 inches, a width of no less than 0.10 inches and a length of no less than 2.75 inches, a width of no less than 0.10 inches and a length of no less than 3.0 inches, a width of no less than 0.10 inches and a length of no less than 3.25 inches, a width of no less than 0.10 inches and a length of no less than 3.5 inches, a width of no less than 0.10 inches and a length of no less than 4.0 inches, a width of no less than 0.10 inches and a length of no less than 5.0 inches, a width of no less than 0.10 inches and a length of no less than 6.0 inches, a width of no less than 0.10 inches and a length of no less than 7.0 inches and a width of no less than 0.30 inches and a length of no less than 7.25 inches.

15. The container of claim 12, wherein said container is combined with a bubble creation device to form a bubble creation apparatus, and wherein said bubble creation device is removably positioned at least partially within said container, said bubble creation device having a fixed geometry bubble creation opening, and wherein said bubble creation opening defines a bubble creation opening adapted such that a sphere may pass through said fixed geometry bubble creation opening, said sphere comprising a sphere having at least one of the following diameters comprising a diameter of no less than 1.25 inches, a diameter of no less than 1.50 inches, a diameter of no less than 1.75 inches, a diameter of no less than 2.00 inches, a diameter of no less than 2.25 inches, a diameter of no less than 2.50 inches, a diameter of no less than 2.75 inches, a diameter of no less than 3.00 inches, a diameter of no less than 3.50 inches, a diameter of no less than 4.00 inches, a diameter of no less than 4.50 inches, a diameter of no less than 5.0 inches, a diameter of no less than 6.0 inches and a diameter of no less than 6.25 inches.

16. The container of claim 12, wherein said container is combined with a bubble creation device to form a bubble creation apparatus, and wherein said bubble creation device is removably positioned at least partially within said container, said bubble creation device having a bubble creation opening, and wherein said apparatus has a bubble solution efficiency ratio (BSER), and wherein said BSER defines at least one of the following BSERs comprising a BSER of no less than 0.125, a BSER of no less than 0.150, a BSER of no less than 0.175, a BSER of no less than 0.200, a BSER of no less than 0.225, a BSER of no less than 0.250, a BSER of no less than 0.275, a BSER of no less than 0.300, a BSER of no less than 0.325, a BSER of no less than 0.350, a BSER of no less than 0.375, a BSER of no less than 0.400, a BSER of no less than 0.425, a BSER of no less than 0.450, a BSER of no less than 0.475, a BSER of no less than 0.500, a BSER of no less than 0.600, a BSER of no less than 0.700, a BSER of no less than 0.800, a BSER of no less than 0.900, a BSER of no less than 1.00, a BSER of no less than 1.25, a BSER of no less than 1.50, a BSER of no less than 1.75, a BSER of no less than 2.00, a BSER of no less than 2.50, a BSER of no less than 2.75, a BSER of no less than 3.00, a BSER of no less than 3.50, a BSER of no less than 4.00, a BSER of no less than 5.0, a BSER of no less than 6.0, a BSER of no less than 7.0, a BSER of no less than 8.0, a BSER of no less than 9.0, a BSER of no less than 10, a BSER of no less than 11, a BSER of no less than 12, a BSER of no less than 13 and a BSER of no less than 14.

17. A spill-resistant bubble creation apparatus for use in accessing bubble creation solution in said apparatus to create large bubbles while preventing spillage of bubble creation solution in said apparatus and while minimizing the quantity of bubble creation solution required to create a bubble, said apparatus comprising a container having an inner cavity and an open funnel extending into said inner cavity and a bubble creation device removably positioned at least partially within said container, wherein said bubble creation device includes a bubble creation opening, and wherein said apparatus has a bubble solution efficiency ratio (BSER) of at least 0.600.

18. The apparatus of claim 17, wherein said BSER defines at least one of the following BSERs comprising a BSER of no less than 0.700, a BSER of no less than 0.800, a BSER of no less than 0.900, a BSER of no less than 1.00, a BSER of no less than 1.25, a BSER of no less than 1.50, a BSER of no less than 1.75, a BSER of no less than 2.00, a BSER of no less than 2.50, a BSER of no less than 2.75, a BSER of no less than 3.00, a BSER of no less than 3.50, a BSER of no less than 4.00, a BSER of no less than 5.0, a BSER of no less than 6.0, a BSER of no less than 7.0, a BSER of no less than 8.0, a BSER of no less than 9.0, a BSER of no less than 10, a BSER of no less than 11, a BSER of no less than 12, a BSER of no less than 13 and a BSER of no less than 14.

19. The apparatus of claim 17, wherein said funnel defines a funnel having a substantially rectangular shaped cross-section.

20. The apparatus of claim 19, wherein an opening of said funnel defines a substantially rectangular shaped open cross-section having a width and length combination of at least one of the following width and length combinations comprising a width of no less than 0.10 inches and a length of no less than 1.75 inches, a width of no less than 0.10 inches and a length of no less than 2.0 inches, a width of no less than 0.10 inches and a length of no less than 2.25 inches, a width of no less than 0.10 inches and a length of no less than 2.5 inches, a width of no less than 0.10 inches and a length of no less than 2.75 inches, a width of no less than 0.10 inches and a length of no less than 3.0 inches, a width of no less than 0.10 inches and a length of no less than 3.25 inches, a width of no less than 0.10 inches and a length of no less than 3.5 inches, a width of no less than 0.10 inches and a length of no less than 4.0 inches, a width of no less than 0.10 inches and a length of no less than 5.0 inches, a width of no less than 0.10 inches and a length of no less than 6.0 inches, a width of no less than 0.10 inches and a length of no less than 7.0 inches and a width of no less than 0.30 inches and a length of no less than 7.25 inches.

21. The apparatus of claim 17, wherein said bubble creation opening defines a fixed geometry bubble creation opening, and wherein said bubble creation opening defines a bubble creation opening adapted such that a sphere may pass through said fixed geometry bubble creation opening, said sphere comprising a sphere having at least one of the following diameters comprising a diameter of no less than 1.25 inches, a diameter of no less than 1.50 inches, a diameter of no less than 1.75 inches, a diameter of no less than 2.00 inches, a diameter of no less than 2.25 inches, a diameter of no less than 2.50 inches, a diameter of no less than 2.75 inches, a diameter of no less than 3.00 inches, a diameter of no less than 3.50 inches, a diameter of no less than 4.00 inches, a diameter of no less than 4.50 inches, a diameter of no less than 5.0 inches, a diameter of no less than 6.0 inches and a diameter of no less than 6.25 inches.

22. The apparatus of claim 17, wherein the configuration of said apparatus is such that when said apparatus is in an upright position, said inner cavity is accessible by said bubble creation device with said bubble creation opening of said bubble creation device in a vertical orientation.

23. The apparatus of claim 17, wherein said container defines an assembly of at least a first container portion and a second container portion, and wherein said first container portion defines a container portion having an inner cavity, an open funnel extending into said inner cavity, and a spout, and wherein said second container portion defines a container portion having an inner cavity, and wherein said second container portion is removably and sealingly connected to said spout of said first container portion.

24. A spill-resistant bubble creation apparatus for use in accessing bubble creation solution in said apparatus to create large bubbles while preventing spillage of bubble creation solution in said apparatus and while minimizing the quantity of bubble creation solution required to create a bubble, said apparatus comprising a container having an inner cavity and an open funnel extending into said inner cavity and a bubble creation device removably positioned at least partially within said container, wherein said funnel includes a substantially rectangular shaped open cross-section having an opening width of at least 0.10 inches and an opening length of at least 1.50 inches.

25. The apparatus of claim 24, wherein said substantially rectangular shaped open cross-section defines a substantially rectangular shaped open cross-section having a width and length combination of at least one of the following width and length combinations comprising a width of no less than 0.10 inches and a length of no less than 1.75 inches, a width of no less than 0.10 inches and a length of no less than 2.0 inches, a width of no less than 0.10 inches and a length of no less than 2.25 inches, a width of no less than 0.10 inches and a length of no less than 2.5 inches, a width of no less than 0.10 inches and a length of no less than 2.75 inches, a width of no less than 0.10 inches and a length of no less than 3.0 inches, a width of no less than 0.10 inches and a length of no less than 3.25 inches, a width of no less than 0.10 inches and a length of no less than 3.5 inches, a width of no less than 0.10 inches and a length of no less than 4.0 inches, a width of no less than 0.10 inches and a length of no less than 5.0 inches, a width of no less than 0.10 inches and a length of no less than 6.0 inches, a width of no less than 0.10 inches and a length of no less than 7.0 inches and a width of no less than 0.30 inches and a length of no less than 7.25 inches, and wherein said apparatus has a bubble solution efficiency ratio (BSER) of at least one of the following BSERs comprising a BSER of no less than 0.125, a BSER of no less than 0.150, a BSER of no less than 0.175, a BSER of no less than 0.200, a BSER of no less than 0.225, a BSER of no less than 0.250, a BSER of no less than 0.275, a BSER of no less than 0.300, a BSER of no less than 0.325, a BSER of no less than 0.350, a BSER of no less than 0.375, a BSER of no less than 0.400, a BSER of no less than 0.425, a BSER of no less than 0.450, a BSER of no less than 0.475, a BSER of no less than 0.500, a BSER of no less than 0.600, a BSER of no less than 0.700, a BSER of no less than 0.800, a BSER of no less than 0.900, a BSER of no less than 1.00, a BSER of no less than 1.25, a BSER of no less than 1.50, a BSER of no less than 1.75, a BSER of no less than 2.00, a BSER of no less than 2.50, a BSER of no less than 2.75, a BSER of no less than 3.00, a BSER of no less than 3.50, a BSER of no less than 4.00, a BSER of no less than 5.0, a BSER of no less than 6.0, a BSER of no less than 7.0, a BSER of no less than 8.0, a BSER of no less than 9.0, a BSER of no less than 10, a BSER of no less than 11, a BSER of no less than 12, a BSER of no less than 13 and a BSER of no less than 14.

* * * * *